United States Patent [19]

Hagerman et al.

[11] Patent Number: 4,685,671

[45] Date of Patent: Aug. 11, 1987

[54] MULTI-PURPOSE EXERCISER

[75] Inventors: Gene R. Hagerman, Truckee; John W. Atkins; John G. McMurtry, both of South Lake Tahoe, all of Calif.

[73] Assignee: Sport Cord, Inc., South Lake Tahoe, Calif.

[21] Appl. No.: 926,002

[22] Filed: Oct. 31, 1986

[51] Int. Cl.[4] ..... A63B 21/02

[52] U.S. Cl. ..... 272/139; 272/136; 272/900

[58] Field of Search ..... 272/135, 136, 137, 138, 272/139, 142, 143, 900

[56] References Cited

U.S. PATENT DOCUMENTS

| | | | |
|---|---|---|---|
| 189,539 | 4/1877 | Wood | 272/136 |
| 1,969,165 | 8/1934 | Turner | 272/79 |
| 2,085,320 | 6/1937 | Kolstrand | 272/142 X |
| 2,930,614 | 3/1960 | McIntosh | 272/137 |
| 3,677,543 | 7/1972 | Richardson | 272/136 |
| 4,019,734 | 4/1977 | Lee et al. | 272/137 |
| 4,060,240 | 11/1977 | Dunston | 272/126 |
| 4,073,490 | 2/1978 | Feather | 272/136 |
| 4,212,458 | 7/1980 | Bizilia | 272/93 |
| 4,245,839 | 1/1981 | Trent | 272/116 |

FOREIGN PATENT DOCUMENTS

| | | | |
|---|---|---|---|
| 619327 | 12/1926 | France | 272/142 |
| 434067 | 8/1935 | United Kingdom | 272/142 |

*Primary Examiner*—Andrew V. Kundrat

*Attorney, Agent, or Firm*—Phillips, Moore, Lempio & Finley

[57] ABSTRACT

A home/travel exerciser comprises an elastomeric cord having a grip adjustably attached to each end thereof. An anchor strap is adjustably mounted on the cord, between the grips, for insertion between a door jamb and a door to hold the exerciser in a fixed position when the door is closed. Foot straps may be attached to the grips and a belt can be releasably attached to the grips to adapt the exerciser for various exercises.

18 Claims, 6 Drawing Figures

FIGURE 4
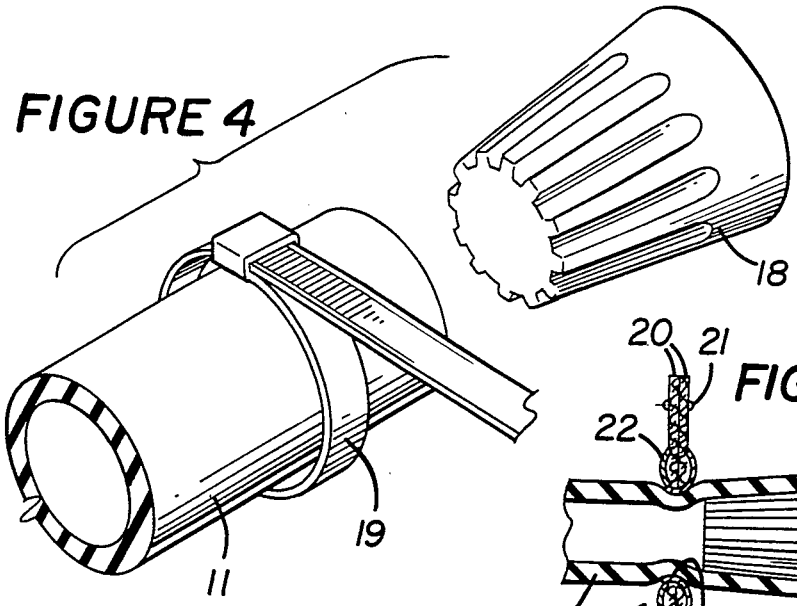
FIGURE 5
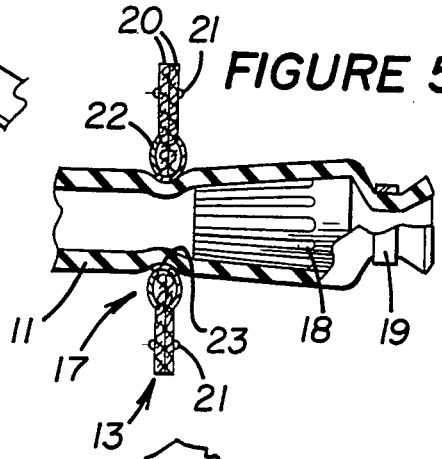
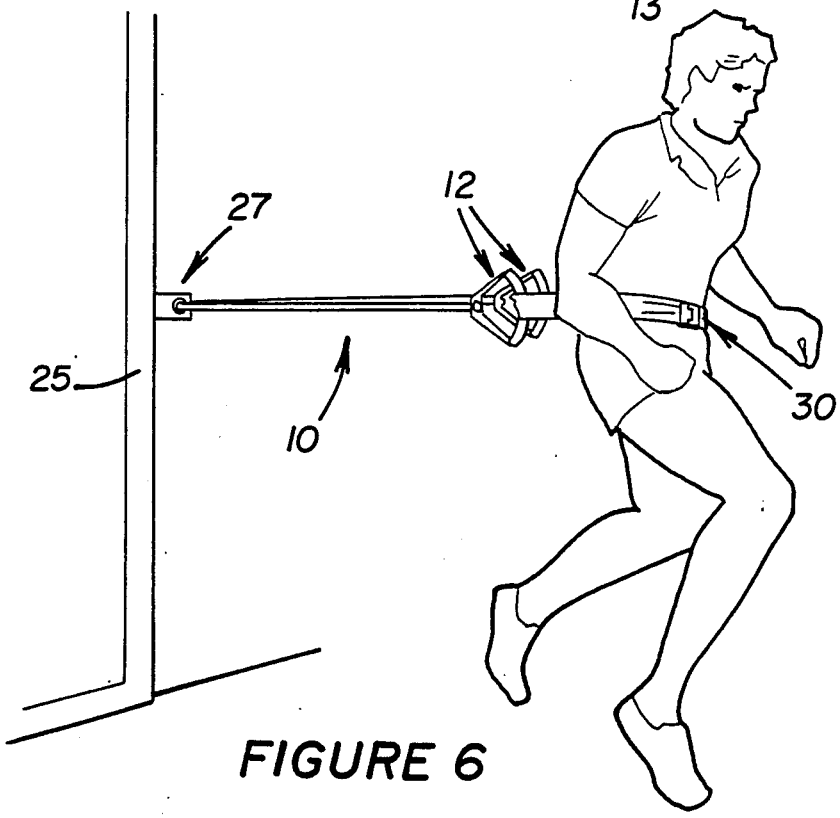
FIGURE 6

MULTI-PURPOSE EXERCISER

TECHNICAL FIELD

This invention relates to an exerciser and more particularly to a stretchable exercise device adapted to exercise and train various muscles of a human body.

BACKGROUND ART

The increased use of training exercises for various muscle groups has given rise to the commercialization of numerous portable devices for this purpose. For example U.S. Pat. No. 4,060,240 discloses a portable exercise device wherein a cable and pulley system, adapted to be attached between a door jamb and a closed door, permits a user to assume various positions and the undertaking of various exercises. A somewhat similar device, particularly adapted for a jogging-in-place exercise, is disclosed in U.S. Pat. No. 4,245,839. U.S. Pat. No. 1,969,165 discloses a similar exercise devide wherein an elastomeric element is adapted to be pulled to effect certain exercises.

Exercise devices of the above type are limited in their application to the training of a limited number of muscle groups and cannot be adjusted to accommodate persons having varied physical capabilities and statures. For example, the inextensible cable and pulley type of device, is incapable of aiding in many of the exercises hereinafter described in this application. The exerciser of this invention provides a complete home/travel exercise device to increase or maintain strength, aid in flexibility, and provide aerobic training capabilities for a wide range of muscle groups.

DISCLOSURE OF INVENTION

This invention provides an improved multi-purpose exerciser for training a wide range of muscle groups through an athletic and functional range of motion. The exerciser is economical to manufacture, portable and easy to use.

The exerciser of this invention comprises an elongated elastic member or cord composed of an elastomeric material capable of stretching in response to imposition of a pulling force thereon. A hand grip is attached to each end of the member. In the preferred embodiment of this invention, adjustment means are provided for moving each grip to a selected position on the member and for frictionally holding the grip thereat when the pulling force is imposed on the exerciser. The adjustment of the grips on the elastic member ensures that the exerciser can be adjusted to accommodate persons having various physical capabilities and statures. For example, shortening the effective length of the elastic member will proportionately increase the magnitude force or strength required to stretch the member a given distance. Also, such adjustment adapts the exerciser for use in areas of various sizes.

In another aspect of this invention, a strap is attached to the elastomeric member, intermediate the grips, and is adapted to be inserted between a door jamb and closed door for holding the exerciser in a fixed position for exercise purposes.

In still another aspect of this invention, a belt is adapted to be attached to the elastic member to adapt it for a jogging-in-place exercise, for example.

BRIEF DESCRIPTION OF THE DRAWINGS

Other advantages and objects of this invention will become apparent from the following description and accompanying drawings wherein:

FIG. 4 is an exploded pre-assembly view, illustrating an end of an elastomeric member used in the exerciser; and FIG. 5 is an enlarged sectional view, taken in the direction of arrows V—V in FIG. 1; and FIG. 6 illustrates use of the exerciser for a jogging-in-place exerciser.

BEST MODE OF CARRYING OUT THE INVENTION

Figure 1:
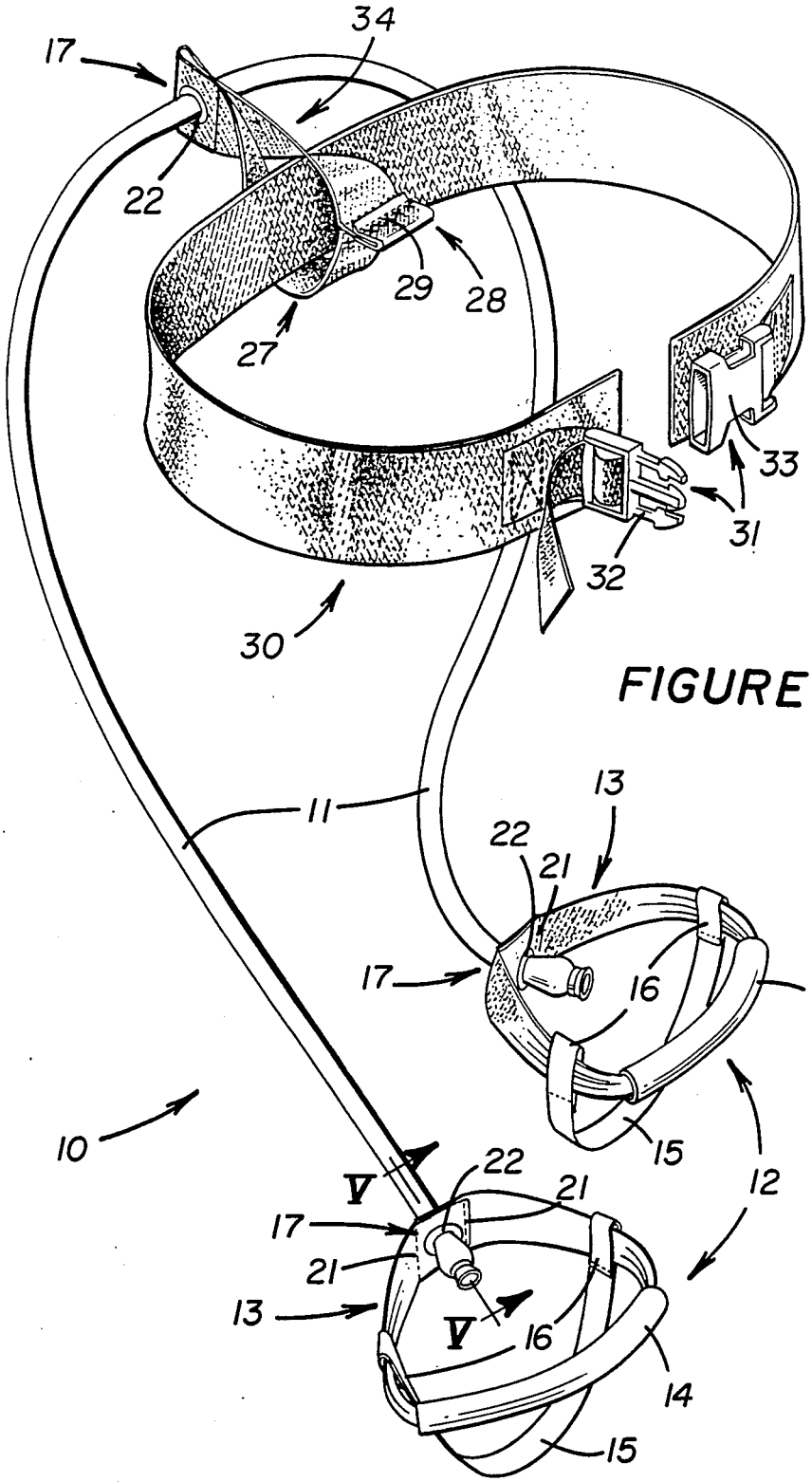
FIG. 1 is an isometric view illustrating a multi-purpose exerciser embodying this invention.
Figure 2:
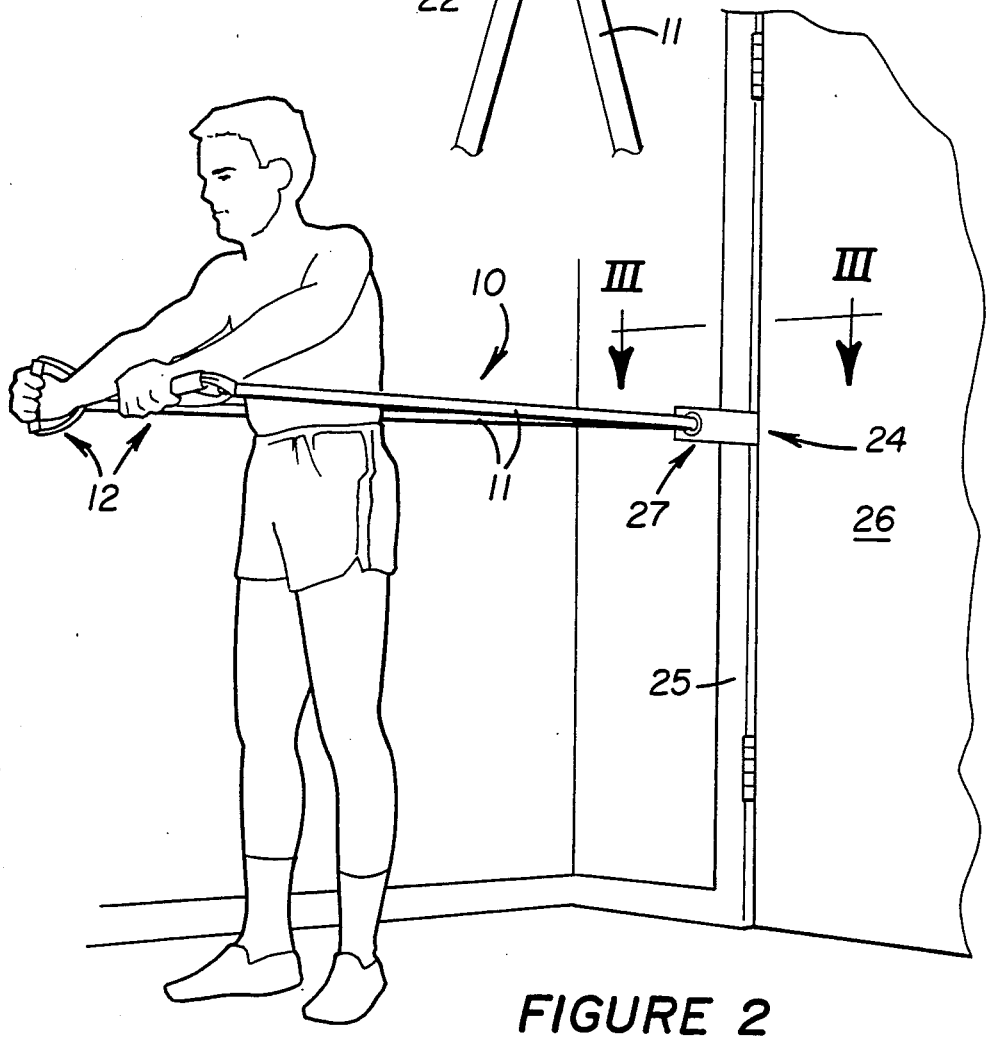
FIG. 2 illustrates one use of the exerciser.

FIG. 1 illustrates an exerciser 10 adapted for multiple uses, such as the exercises illustrated in FIGS. 2 and 6. The exerciser comprises an elongated elastic member, cord or tube 11 composed of an elastomeric material capable of stretching in response to imposition of a pulling force thereon. The elastomeric material, such as a suitably composed a polyurethane or other suitable type of thermoplastic elastomer, exhibits high elongation and elastic recovery dictated by the desired mechanical properties, such as tensile strength, elongation, tensile elastic modulus, flexural yield strength, flexural elastic modulus and related properties, required to effect the various types of exercises hereinafter more fully dscribed. For example, the type of polyurethane elastomer used for standard surgical tubing has proved excellent for this purpose.

The physical dimensions of the tube will also dictate design criteria for a particular embodiment of the exerciser. For example, and in actual practice, surgical tubing having a length approximating 5.0 ft., an outside diameter of 0.625 in. and an inside diameter of 0.25 in. has proved effective for carrying forth all of the exercises under consideration.

Exerciser 10 further comprises a closed hand grip or handle 12 attached to each end of tube 11. Each grip comprises a woven Nylon hand strap 13 forming a loop having a plastic tube or grip cover 14 loosely mounted on the hand strap. A second woven Nylon foot strap or stirrup 15 can be suitably loosely attached for movement on hand strap 13 by a pair of stitched loops 16 for purposes hereinafter explained.

Referring to FIGS. 1 and 5, each grip 12 is preferably attached to a respective end of tube 11 by an adjustment means 17 for moving the grip to a selected position on the tube and for frictionally holding the grip at such selected position when a pulling force is imposed thereon. As shown in FIGS. 4 and 5, a frustoconically shaped plug 18 has its smaller end inserted inwardly within a respective open end of tube 11, after hand grip 12 has been positioned on the tube. The plug may comprise a standard cup-shaped connector for electrical wires that is normally threaded internally (not shown). A plastic cinch or strap 19 is tightened-down on the end of the tube, as further shown in FIG. 5, to retain plug 18 in a fixed position and thus provide a stop means for preventing inadvertent removal of the grip from the tube.

As further shown in FIGS. 1 and 5, strap 13 is preferably reinforced by a pair of overlapping ends 20 of strap 13 that are stiched together at 21, on either side of a metal grommet 22. The grommet is suitably secured within a hole preformed in overlapping ends 20 of the strap and has an inside diameter less than the outside diameter of normally relaxed tube 11. Thus, the tube will be compressed radially inwardly and circumferentially by the grommet to aid in retaining it and grip 12 at a selected position on the tube.

An inner surface 23 of the grommet, contacting the tube, forms an inner portion of an annular torus to provide a smooth and curved surface 23, hen viewed in cross-section in FIG. 5, to prevent any abrasion or cutting of the tube when the grommet is moved thereon. In one application of this invention, the inside diameter of the grommet constituted 0.5 in. whereas the relaxed outside diameter of the tube constituted 0.625 in.

In actual practice and use of the exerciser, grommet 22 and thus grip 12 can be moved to a selected position on the tube and a knot could be tied behind the grommet (to the right of the grommet when the grommet is moved leftwardly in FIG. 5) to further aid in retaining the grip in position on the tube when a pulling force is applied thereto. However, during the course of most exercises, such a knot is unneeded since such pulling force will tend to tilt the plane of the grommet relative to the tube to mechanically aid the frictional forces between the grommet and tube to prevent the grip from slipping on the tube.

Figure 3:
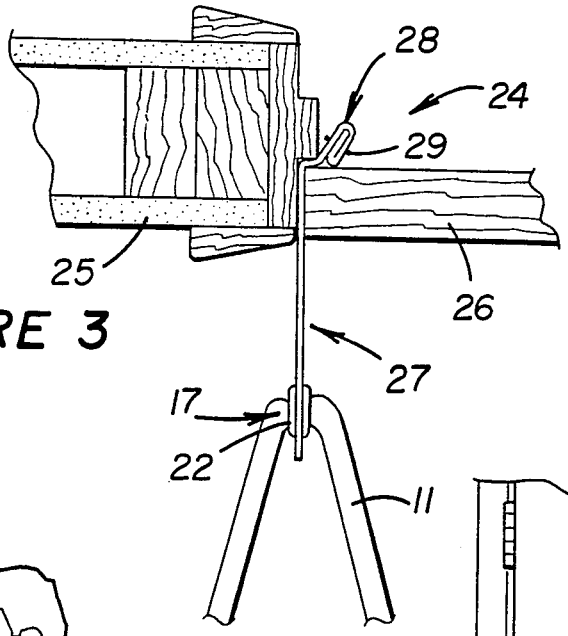
FIG. 3 is an enlarged sectional view, taken in the direction of arrows III—III in FIG. 2.

Referring to FIGS. 1–3, an attachment means 24 is connected to tube 11 and insertable between a door jamb 25 and an inner, hinged edge of a closed and preferably locked door 26. It should be understood that the attachment means could be placed at other vertical positions between the door jamb and door, depending on the particular exercise under consideration. Further, the attachment means could be placed under a closed and locked window.

Attachment means 24 preferably comprises a woven Nylon anchor or attachment strap 27 terminating at its outer end at folded-over and superimposed outer end portions 28, stitched together at 29 (FIGS. 1 and 3), to form a stop having a composite thickness greater than the remaining portions of the strap. The inner end of strap 27 is connected to tube 11 by a third adjustment means 17, including a metal grommet 22 of the type described above. Attachment means 24 can thus be adjusted to a selected position on tube 11, in the manner described above. Grommet 22 of attachment means 24 would be normally positioned intermediate grips 12 for most exercises, i.e., the lengths of the two tube portions between attachment means 24 and the grips would be substantially equal.

Exerciser 10 also preferably includes a belt 30 composed of a woven Nylon material and having a buckle 31 secured thereon. The quick release bukcle may be conventional, such as the type disclosed in U.S. Pat. No. 4,150,464 having a clasp member 32 adapted to be inserted into and locked within a receptacle member 33. As shown in FIG. 1, strap 27 is formed with a loop 34 adapted to receive the belt for certain exercises. Another variation would be to thread the belt through closed grips 12, attach strap 27 between a door jamb and door (FIG. 3) and place the belt around a person's waist for a jogging-in-place exercise (FIG. 6), for example.

Various exercises (with the muscle group exercised in parenthesis), for which the multi-purpose exerciser of this invention is adapted to be used, are as follows:

LAT PULLS (Latissimus - large muscle on the back):

Attach strap 27 high in a door jamb and assume a standing lunge position facing the door. Use a straight arm pull through the full range of motion and repeat the exercise.

ARM CURLS (Biceps - muscles on the front of the upper arms):

Place your feet on tube 11, wider than shoulder width. Knees should be slightly bent. Keeping your elbows close to the sides of your body, clasp handles and slowly bend the arm at the elbow and curl towards the shoulder. Alternate arms while performing this exercise.

CHEST FLYS (Pectorals in the chest and Deltoids in the shoulder):

Attached strap 27 midway in the door jam, assume a standing forward lunge position - one leg in front of the other - with arms outstretched. Slowly bring handles 12 together and resist the tube while bringing arms together. It is important to maintain a straight back position and provide a slow resistance on the return phase.

UPRIGHT ROWING (Deltoids and Trapezius - muscles on the front of shoulder and top of upper back):

While standing on the tube, grasp the handles at waist level. Pull the handles towards your chin.

STOMACH CRUNCH (Abdominals - muscles of the stomach):

Attach strap 27 to a door jamb at waist level and sit in a chair with your back to the door. Bring the handles over the shoulders and hold them at upper chest level. Slowly bend foward as far as you can go.

BACK EXTENSION (Erector Spinae - muscles of the lower back):

Attach strap 27 to a door jamb at waist level and sit in a chair facing the door. Feet should be wide apart while sitting on the front part of the chair. Hold the handles at chest level and bend forward as far as possible. With the tube taut, extend the back, returning to the seated position.

DOUBLE KNEE DIPS (Quadriceps - muscles on front of upper thigh):

Stand on the tube with both feet about 12–20 inches from the handles and pull them to your waist. Slowly lower body to $\frac{1}{3}$ knee bend and repeat. Do not fully extend when returning to starting position.

SINGLE KNEE DIPS (Quadriceps - muscles on front of upper thigh):

Stand on the tube about 12–20 inches from one handle and pull handle to the waist. Raise one foot off the floor and balance with one hand on a wall or chair back. Slowly lower body to a $\frac{1}{3}$ knee bend and repeat exercise. Do not fully extend when returning to the starting position. This exercise should be done slowly to fatigue the muscles in the thigh.

SEATED LEG PRESS (Quadriceps - muscles on the front of the upper thigh):

Sitting in a chair, put one foot on the handle with strap 15 over the instep. Hold the tube taut in your hand to the side of the leg. Extend your knee by pushing down and away from your hand. You should have a slight bend in the knee after completing the exercise.

SEATED HAMSTRING (Hamstrings - muscles on back of upper thigh):

Place strap 27 low in a door jamb. Sitting in a chair, put one foot on strap 15 with grip cover 14 above the heel and extend foot toward the door. The foot should remain on the floor while slowly bending your knee and curling your leg backwards towards your buttocks.

INSIDE-OUTSIDE LEG TONERS (Adductors and Abductors - muscles on the inside and outside of the thigh):

Attach strap 27 in the lower part of the door jamb. Place your feet shoulder-width apart while resting a hand on a chair for balance. To tone the inside leg muscles, place one grip on the foot closest to the door. Keeping your inside leg straight, slowly draw your leg in front of your outside leg. To tone the outside leg muscles, place the one grip on your outside foot and slowly raise it laterally as far as the range of motion permits. Repeat exercises on the opposite leg.

GLUTEAL STRENGTHENERS (Hip Extensors - muscles on the back of the hip):

Attach strap 27 in the lower part of the door jamb. Facing the door, step one leg through both handles and slide them to a position above your knee. Place one hand on a chair for balance. Pre-stretch the tube by stepping backward into a backward lunge position. With bent knee, kick back as high as possible using a dynamic motion.

HIP PULLS (Hip Flexors - muscles on the front of the hip):

Attach strap 27 in the lower part of a door jamb. Facing away from the door, step one leg through the handles and slide them to a position above the knee. Place one hand on a chair for balance. Pre-stretch the cord tube by stepping out into a lunge position. Raise your exercising leg as high as possible in a dynamic motion and return to the original position.

WALK-JOG (Muscles of the upper and lower leg):

As shown in FIG. 6, attach strap 27 midway in a door jamb. Place belt 30 through the handles and around your waist. Slowly walk or jog away from the door until you feel tension. Use good walk-jog form by facing forward with elbows approximately waist level and maintain a smooth leg motion. By leaning slightly forward and with your knees bent, you can avoid added stress at the hip, knee and ankle joints. Perform this exercise for 5–15 minutes.

LATERAL AGILITY (Muscles of the upper and lower leg):

Attach strap 27 midway, in a door jamb. Place the belt through the handles and around your waist. Start in a compact, low crouch position facing sideways to the door attachment. Lean slightly away from the door to place tension on the tube. Hold your arms away from your body for added balance and begin with the foot closest to the door and hop horizontally to the outside foot. This exercise emphasizes the muscles of the leg closest to the door (the inside foot). Rotate in the belt and face in the opposite direction to work the other leg. As you become proficient with the exercise, gradually move away from the door to add resistance.

I claim:

1. An exerciser comprising an elongated elastic member composed of an elastomeric material capable of stretching in response to imposition of a pulling force thereon, a hand grip attached to each end of said member, adjustment means for moving said grip to a selected position on said member and for frictionally holding said grip at said selected position when said pulling force is imposed thereon, attachment means connected to said member and insertable between a door jamb and an outer edge of a door for holding said device in a fixed position between said door jamb and said door upon closing of said door, and belt means for placement about a person's waist and connectable to said attachment means and to each said grip and buckle means for attaching ends of said belt means together.

2. The exerciser of claim 1 wherein said attachment means defines a loop and said belt is inserted through said loop.

3. The exerciser of claim 1 wherein said member constitutes an elastomeric tube, said grip comprises a hand strap and said adjustment means comprises a grommet secured to said hand strap and mounted on said tube.

4. The exerciser of claim 3 wherein said grommet has an inside diameter less than a relaxed outside diameter of said tube to compress said tube to frictionally hold said grommet at a selected position thereon.

5. The exerciser of claim 3 further comprising stop means secured on each end of said tube for preventing a respective one of said hand straps from being removed from said tube.

6. The exerciser of claim 3 wherein said stop means comprises a frustoconically shaped plug inserted in a respective open end of said tube and means for fixing said plug in said tube.

7. The exerciser of claim 3 further comprising a plastic tube mounted in covering relationship on said hand grip.

8. The exerciser of claim 3 further comprising a second strap attached to said hand strap.

9. The exerciser of claim 8 wherein each end of said second strap forms a closed loop mounted for sliding movements on said hand strap.

10. The exerciser of claim 1 wherein said attachment means comprises an attachment strap, a grommet secured to a first end of said attachment strap and mounted on said tube and wherein a second end of said strap is folded-over and secured together to define a stop having a composite thickness greater than intermediate portions of said strap between said grommet and said stop.

11. The exerciser of claim 10 wherein said grommet has an inside diameter less than a relaxed outside diameter of said tube to compress said tube radially inwardly to frictionally hold said strap in a selected position on said tube.

12. An exerciser comprising an elongated elastomeric and stretchable cord, a hand grip attached to each end of said cord, said grip comprising a closed hand strap having a grommet secured thereon, said grommet mounted on said cord, and attachment means connected to said cord and insertable between a door jamb and an edge of a door for holding said exerciser in a fixed position upon closing of said door, said attachment means comprising a strap having a grommet secured thereto, and mounted on said cord.

13. The exerciser of claim 12 wherein the strap of said attachment means defines a loop and further comprising a belt insertable either through said loop or through said hand strap and buckle means for releasably attaching free ends of said belt together.

14. The exerciser of claim 12 further comprising a plastic tube mounted in covering relationship on said hand strap.

15. The exerciser of claim 14 further comprising a foot strap having opposite ends thereof attached to said hand strap.

16. An exerciser comprising an elongated elastomeric and stretchable cord, a hand grip attached to each end of said cord, said grip comprising a closed hand strap, attachment means connected to said cord and insertable between a door jamb and an edge of a door for holding said exerciser in a fixed position upon closing of said door, said attachment means comprising a strap, and a belt insertable through said hand strap and having buckle means for releasably attaching free ends of said belt together.

17. An exerciser comprising an elongated elastic tube composed of an elastomeric material capable of stretching in response to imposition of a pulling force thereon, a hand grip comprising a hand strap attached to each end of said member, adjustment means comprising a grommet secured to said hand strap and mounted on said tube for moving said grip to a selected position on said member and for frictionally holding said grip at said selected position when said pulling force is imposed thereon, and a second strap attached to said hand strap, each end of said second strap forming a closed loop mounted for sliding movements on said hand strap.

18. An exerciser comprising an elongated elastic member composed of an elastomeric material capable of stretching in response to imposition of a pulling force thereon, a hand grip attached to each end of said member, adjustment means for moving said grip to a selected position on said member and for frictionally holding said grip at said selected position when said pulling force is imposed thereon, and attachment means connected to said member and insertable between a door jamb and an outer edge of a door for holding said device in a fixed position between said door jamb and said door upon closing of said door, said attachment means comprising an attachment strap, a grommet secured to a first end of said attachment strap and mounted on said tube and whrein a second end of said strap is folded-over and secured together to define a stop having a composite thickness greater than intermediate portions of said strap between said grommet and said stop.

* * * * *